US005270123A

United States Patent [19]

Walston et al.

[11] Patent Number: 5,270,123

[45] Date of Patent: Dec. 14, 1993

[54] NICKEL-BASE SUPERALLOY AND ARTICLE WITH HIGH TEMPERATURE STRENGTH AND IMPROVED STABILITY

[75] Inventors: William S. Walston, Maineville; Earl W. Ross, Cincinnati, both of Ohio; Kevin S. O'Hara, Boxford, Mass.; Tresa M. Pollock, Pittsburgh, Pa.

[73] Assignee: General Electric Company, Cincinnati, Ohio

[21] Appl. No.: 846,643

[22] Filed: Mar. 5, 1992

[51] Int. Cl.[5] ..... C22C 19/05; C22F 1/10

[52] U.S. Cl. ..... 428/652; 428/670; 428/680; 148/404; 148/410; 148/675; 148/428; 420/445; 420/443

[58] Field of Search ..... 420/445, 443, 447; 148/410, 675, 404, 428; 428/680, 652, 670

[56] References Cited

U.S. PATENT DOCUMENTS

| | | | |
|---|---|---|---|
| 3,904,402 | 9/1975 | Smashey | 428/445 |
| 4,031,945 | 6/1977 | Gigliotti et al. | 148/404 |
| 4,116,723 | 9/1978 | Gell et al. | 148/404 |
| 4,162,918 | 7/1979 | Huseby | 148/404 |
| 4,169,742 | 10/1979 | Wukusick et al. | 148/404 |
| 4,522,664 | 6/1985 | Gigliotti et al. | 148/404 |
| 4,589,937 | 5/1986 | Jackson et al. | 148/404 |
| 4,719,080 | 1/1988 | Duhl et al. | 420/445 |
| 4,849,030 | 7/1989 | Darolia et al. | 148/404 |
| 5,077,141 | 12/1991 | Naik et al. | 148/404 |
| 5,100,484 | 3/1992 | Wukusick et al. | 148/410 |
| 5,151,249 | 9/1992 | Austin et al. | 420/445 |
| 5,154,884 | 10/1992 | Wukusick et al. | 148/404 |

*Primary Examiner*—John Zimmerman

*Attorney, Agent, or Firm*—Jerome C. Squillaro; Carmen Santa Maria

[57] ABSTRACT

A nickel base superalloy capable of being made into a single crystal article is provided with high temperature strength and improved stability by limiting the Presence of an undesirable SRZ constituent. Significant to the control of formation of such undesirable constituents is the control of the amount of Re in the alloy in combination with elements such as Al, Cr, Ta, Mo, Co and W. A solution heat treatment is provided for additional control.

11 Claims, 5 Drawing Sheets

200X

200X

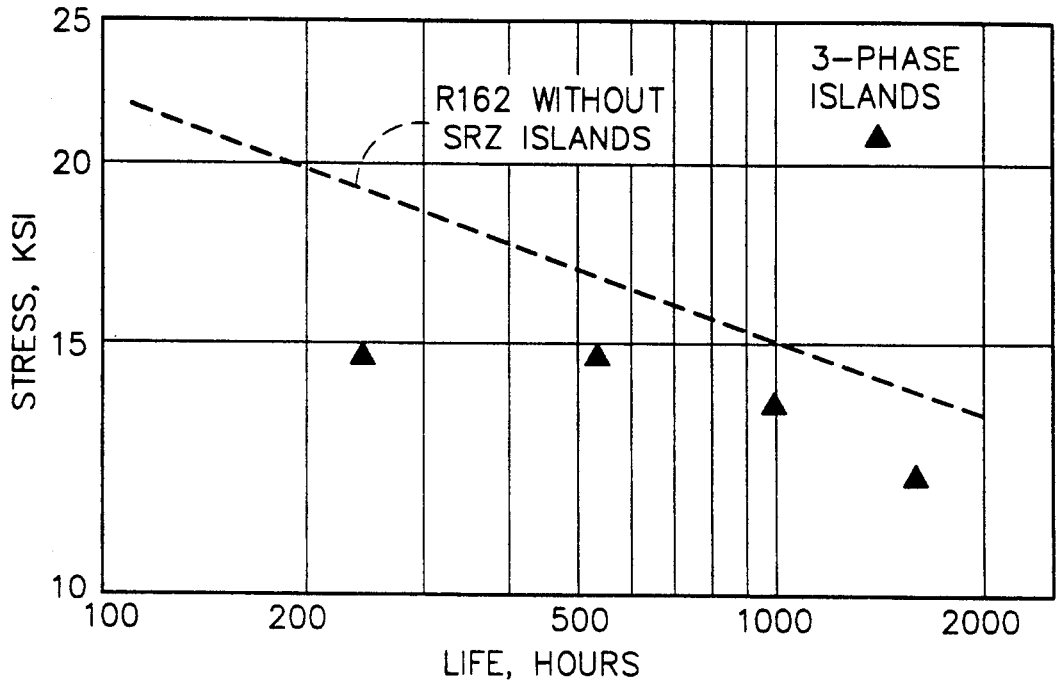
FIG. 3 2000°F STRESS RUPTURE DATA
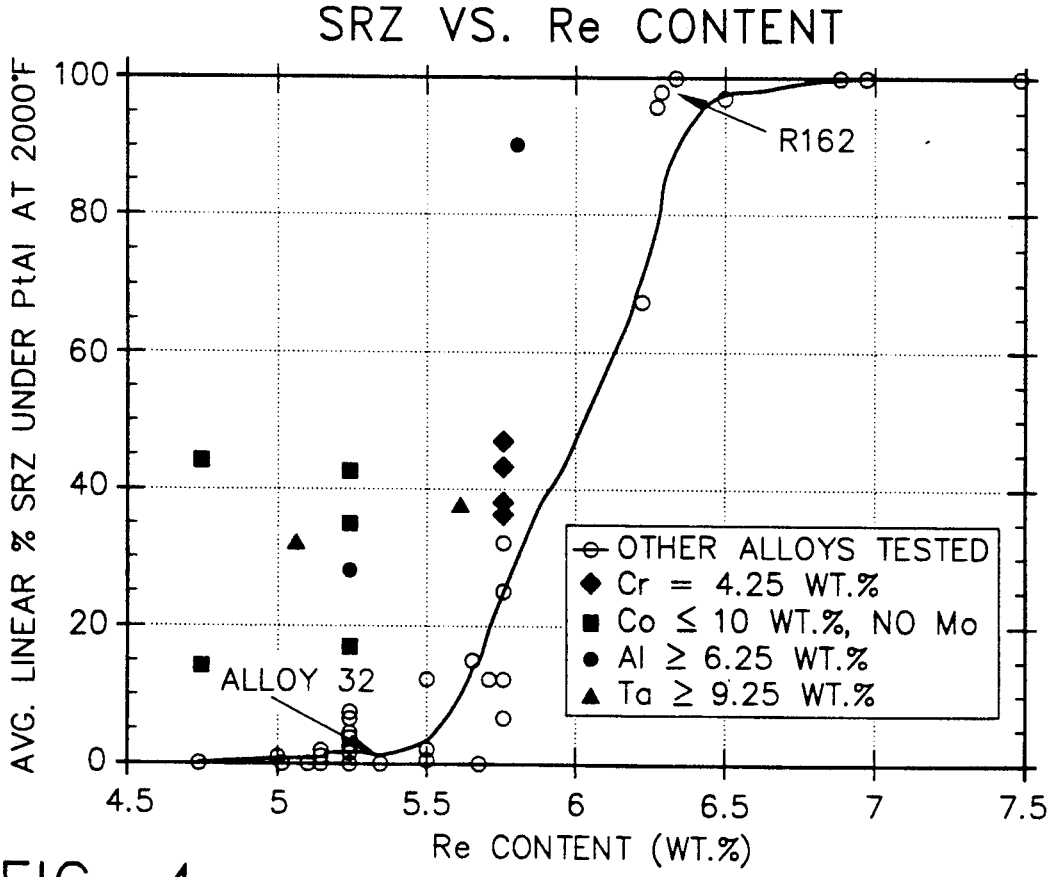
FIG. 4

50X

200X

NICKEL-BASE SUPERALLOY AND ARTICLE WITH HIGH TEMPERATURE STRENGTH AND IMPROVED STABILITY

CROSS REFERENCE TO RELATED APPLICATION

This invention is related to copending U.S. patent application Ser. No. 07/459,400 filed Dec. 29, 1989, now U.S. Pat. No. 5,151,239, C. M. Austin, et al., assigned to the same assignee of this application. The disclosure of such copending application is hereby incorporated herein by reference.

BACKGROUND OF THE INVENTION

This invention relates to nickel base superalloys, and, more particularly to such alloys for use at about 2000° F. and above, especially as single crystal shapes.

One important and continuing development which has enabled designers of gas turbine engines to Provide more efficient and higher temperature operating aircraft engines is the evolution of the nickel based superalloy. The published art describes early turbine section components of such alloys as members having a predominantly multi-grained equiaxed microstructure. Later came the development of directional solidification of cast components leading to grain structures of multiple, axially elongated grains and then to single crystal structures.

Because the single crystal structures avoided grain boundaries, compositional elements added solely for grain boundary strengthening were eliminated. However, the formation in the microstructure of the single crystal of phases detrimental to the strength and integrity of the component made therefrom increased in importance as the intended application temperature increased. For example, it has been recognized that there can form in certain nickel base superalloys, including those designed for the manufacture of single crystal structures, a constituent which can result in loss of mechanical properties, Particularly stress rupture life, after exposure to temperatures of at least about 1800° F. Such a detrimental formation consists essentially of an orthorombic "P" Phase which is a Type II topologically close-packed (TCP) phase, and a gamma Phase, both dispersed in a gamma prime matrix, the TCP phase and the gamma phase forming needlelike structures within the blocky gamma prime matrix. This detrimental formation is hereinafter referred to as a Secondary Reaction Zone (SRZ).

SUMMARY OF THE INVENTION

The present invention, in one form, provides a nickel base superalloy of improved high temperature strength and stability through the avoidance of detrimental amounts of SRZ after exposure at temperatures of at least about 1800° F. An important feature of this Present invention is the combination of Re content in the presence of Al, Cr, Ta and Mo, providing an alloy composition, in weight percent, of about 5.1-5.6 Re, about 5 to less than 6.25 Al, greater than 4.25 to about 6 Cr, about 7 to less than 9.25 Ta, and about 0.5-2 Mo, along with about 10-15 Co, about 5-6.5 W about 0.1-0.5 Hf, about 0.02-0.07 C, about 0.003-0.01 B, about 0-0.03 Y, about 0-6 Ru, about 0-1 Cb with the balance Ni and incidental impurities. In one form, the alloy is characterized by the substantial absence of SRZ in its internal microstructure after exposure at about 2000° F. for about 1000 hours under a stress of about 15 thousands of pounds per square inch (ksi).

In another form, the present invention provides a stable nickel base superalloy article with a single crystal structure and a coating which includes at least one of the elements Al and Pt. One form of such a coating is a PtA1 coating deposited by chemical vapor deposition (CVD) for environmental protection at elevated temperatures.

In another form in which the alloy is coated with a coating of Al, Pt or their mixtures or alloys, the present invention is characterized by including no more than about 2% SRZ linearly beneath and adjacent to the coating after exposure at a temperature of about 1800° F. for about 400 hours with no applied stress.

BRIEF DESCRIPTION OF THE DRAWINGS

FIG. 3 is a graphical comparison of stress rupture life of alloys with and without SRZ within its body.

FIG. 4 is a graphical comparison of formation of SRZ as a function of Re content in the alloy.

DETAILED DESCRIPTION OF THE PREFERRED EMBODIMENTS

During extensive evaluation of the alloy described in the above cross-referenced and herein incorporated U.S. Pat. No. 5,151,249, it was confirmed that such alloy possessed very good creep rupture properties at temperatures from about 1600° F. up to at least 2100° F. However, under certain conditions, the alloy was susceptible to unstable reactions after exposure at high temperatures, resulting in formation of the above identified SRZ.

Figure 1:
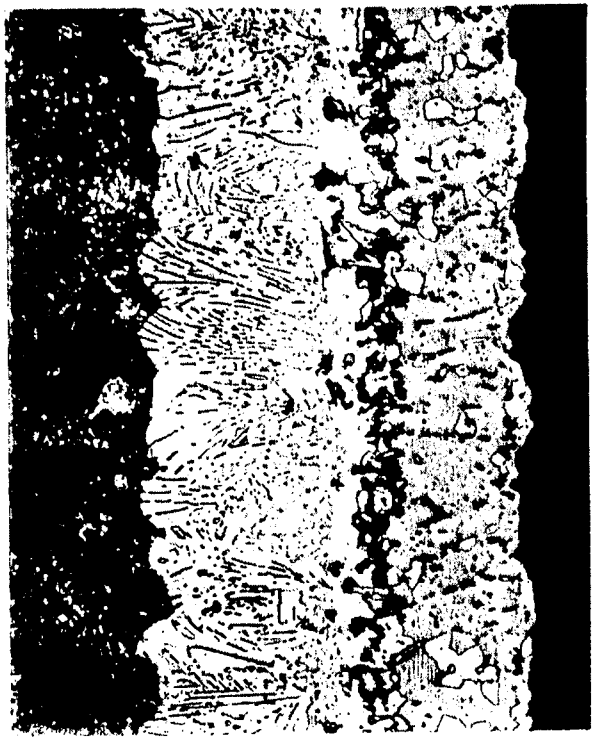
FIG. 1 is an optical photomicrograph at 200× showing SRZ beneath a PtA1 coated nickel base superalloy after 2000° F. exposure for 400 hours.

One condition involved the alloy coated with Al or an Al alloy, particularly PtA1 coatings, deposited for environmental resistance. Aluminum-containing coatings are typically applied to turbine airfoils. Such SRZ was more Prevalent beneath the PtA1 coating after exposure at temperatures of at least about 1800° F., even without applied load. The formation of large amounts of SRZ immediately beneath the coating reduced the load Carrying capability and Stress rupture life compared with the same alloy without a coating. The photomicrograph of FIG. 1 shows such formation.

Figure 2:
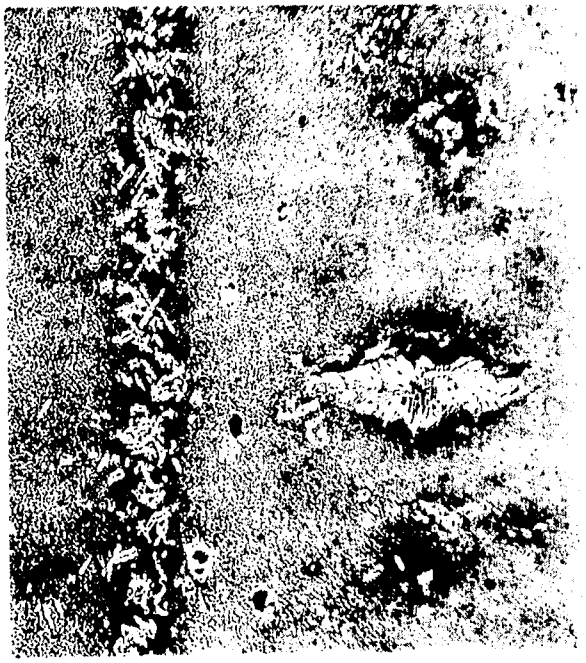
FIG. 2 is a photomicrograph at 200× showing a globular island of SRZ within the alloy after 2000° F. exposure under a 15 ksi load.

Another, more serious condition involved exposure of the alloy at 2000° F. under a stress load held for lengthy times, for example 1000 hours at 15 ksi. The result was the formation of a constituent very similar to SRZ within the alloy. The result was significantly decreased stress rupture life of the alloy. The Photomicrograph of FIG. 2 shows formation of the more globular three phase (gamma, gamma prime and p-phase) SRZ islands within the body of the alloy near the fracture surface after exposure at about 2000° F. under a stress load of about 15 ksi. The effect of such globular islands on stress rupture life is shown by the data included in the graphical presentation of FIG. 3. The alloy used in the development of data represented by FIGS. 1, 2 and 3, herein referred to as R'162 alloy, had a composition within the scope of the above cross-referenced patent application and consisted nominally in weight percent 6.3% Re, 12.5Co, 7% Ta, 4.5% Cr, 5.8% W, 6.3% Al, 0.004% B, 0.05% C, 0.15% Hf, balance Ni and incidental impurities. In FIG. 3, the data presented as a broken line were forms of R'162 alloy which did not include SRZ. The data points shown as black triangles were forms of R'162 alloy including substantial 3-phase islands of SRZ, shown in FIG. 2. The data of FIG. 3, along with the data of FIG. 8, discussed below, indicate the exceptional combination of strength and propensity not to form detrimental SRZ. Formation of detrimental SRZ will degrade the strength of the alloy after exposure to high temperatures over a period of time.

As a result of the type of data presented above, and others, in connection with long time instability after exposure to high temperatures under load, or with certain coatings, it was recognized that a new kind of alloy was required for stable use under more severe conditions. It was recognized during evaluation of the present invention that Re content played a significant role within an unexpectedly, relatively narrow composition range. It was found that reducing Re content below that of Alloy R'162 which has a Re content in the range of 5.7–7 wt%, reduced the formation of the undesirable SRZ to 2% or less even under a PtA1 coating. Within the body of the alloy, there was substantially no SRZ with the Re content in the range of about 5.1–5.6 wt% Re. Therefore, according to the present invention, the Re content is maintained within the range of about 5.1–5.6 wt% in the alloy associated with the present invention.

A graphical presentation of the amount of SRZ formation as a function of Re content is shown in FIG. 4. The data of FIG. 4 were developed from a wide variety of single crystal alloy specimens which were coated with PtA1 by CVD Processing, and tested without load at 2000° F. in air for times ranging from 200 hours to 1000 hours. The following Tables I and II identify the composition of alloys evaluated in connection with the present invention.

TABLE I

| Alloy # | Al | Ta | W | Re | Cr | Co | Mo | Hf | C | B | Other |
|---|---|---|---|---|---|---|---|---|---|---|---|
| 0 | 6.20 | 7.00 | 5.75 | 5.25 | 4.50 | 12.50 | 0.00 | 0.15 | 0.05 | 0.004 | |
| 1 | 6.20 | 7.25 | 5.75 | 5.75 | 4.25 | 12.50 | 0.00 | 0.15 | 0.05 | 0.004 | |
| 2 | 6.30 | 7.00 | 5.75 | 5.75 | 4.25 | 12.50 | 0.00 | 0.15 | 0.05 | 0.004 | |
| 3 | 6.00 | 7.00 | 5.75 | 5.75 | 4.25 | 12.50 | 0.00 | 0.15 | 0.05 | 0.004 | 0.5 Ti |
| 4 | 6.00 | 6.50 | 5.75 | 5.75 | 4.25 | 12.50 | 0.00 | 0.15 | 0.05 | 0.004 | 0.5 Ti |
| 5 | 6.00 | 7.00 | 5.75 | 5.75 | 4.50 | 12.50 | 0.00 | 0.15 | 0.05 | 0.004 | 1 Ti |
| 6 | 6.00 | 7.00 | 5.75 | 5.75 | 4.50 | 12.50 | 1.00 | 0.15 | 0.05 | 0.004 | |
| 7 | 6.00 | 7.00 | 5.75 | 5.75 | 4.50 | 12.50 | 0.00 | 0.15 | 0.05 | 0.004 | 1 Cb |
| 8 | 6.20 | 7.00 | 6.00 | 5.50 | 4.50 | 12.50 | 0.00 | 0.15 | 0.05 | 0.004 | |
| 9 | 6.00 | 8.45 | 5.75 | 5.25 | 4.50 | 12.50 | 0.00 | 0.15 | 0.05 | 0.004 | |
| 10 | 6.00 | 8.45 | 6.25 | 5.25 | 4.50 | 12.50 | 0.00 | 0.15 | 0.05 | 0.004 | |
| 11 | 5.50 | 7.85 | 5.75 | 5.25 | 4.50 | 12.50 | 0.00 | 0.15 | 0.05 | 0.004 | 1 Ti |
| 12 | 6.25 | 7.00 | 6.75 | 5.25 | 4.50 | 12.50 | 0.00 | 0.15 | 0.05 | 0.004 | |
| 13 | 6.00 | 7.50 | 5.75 | 5.50 | 4.50 | 12.50 | 1.00 | 0.15 | 0.05 | 0.004 | |
| 14 | 6.00 | 8.00 | 5.75 | 5.50 | 4.50 | 12.50 | 1.00 | 0.15 | 0.05 | 0.004 | |
| 15 | 5.75 | 8.50 | 5.75 | 5.75 | 4.50 | 12.50 | 0.00 | 0.15 | 0.05 | 0.004 | |
| 16 | 6.00 | 8.00 | 5.50 | 5.50 | 4.50 | 12.50 | 0.00 | 0.15 | 0.05 | 0.004 | |
| 17 | 6.00 | 7.00 | 6.50 | 5.25 | 4.50 | 12.50 | 0.00 | 0.15 | 0.05 | 0.004 | |
| 18 | 5.80 | 8.50 | 5.75 | 4.75 | 4.50 | 7.50 | 0.50 | 0.15 | 0.05 | 0.004 | |
| 19 | 5.80 | 8.00 | 5.75 | 5.25 | 4.50 | 7.50 | 0.50 | 0.15 | 0.05 | 0.004 | |
| 20 | 5.80 | 8.00 | 5.75 | 5.25 | 4.50 | 10.00 | 0.50 | 0.15 | 0.05 | 0.004 | |
| 21 | 5.80 | 8.50 | 5.75 | 4.75 | 4.50 | 10.00 | 0.50 | 0.15 | 0.05 | 0.004 | |
| 22 | 5.80 | 8.50 | 5.75 | 5.25 | 4.50 | 10.00 | 0.50 | 0.15 | 0.05 | 0.004 | |
| 23 | 5.80 | 8.50 | 5.75 | 5.25 | 4.50 | 7.50 | 0.50 | 0.15 | 0.05 | 0.004 | |
| 24 | 5.80 | 8.00 | 5.75 | 4.75 | 4.50 | 7.50 | 0.00 | 0.15 | 0.05 | 0.004 | |
| 25 | 5.80 | 8.00 | 5.75 | 4.75 | 4.50 | 10.00 | 0.00 | 0.15 | 0.05 | 0.004 | |
| 26 | 5.80 | 8.50 | 5.75 | 5.25 | 4.50 | 10.00 | 0.00 | 0.15 | 0.05 | 0.004 | |
| 27 | 5.80 | 8.00 | 5.75 | 5.25 | 4.50 | 7.50 | 0.00 | 0.15 | 0.05 | 0.004 | |
| 28 | 5.80 | 8.00 | 5.75 | 4.75 | 4.50 | 7.50 | 0.50 | 0.15 | 0.05 | 0.004 | |
| 29 | 5.80 | 8.50 | 5.75 | 4.75 | 4.50 | 7.50 | 0.00 | 0.15 | 0.05 | 0.004 | |
| 30 | 5.80 | 8.00 | 5.75 | 5.25 | 4.50 | 10.00 | 0.00 | 0.15 | 0.05 | 0.004 | |
| 31 | 5.80 | 8.00 | 5.75 | 4.75 | 4.50 | 10.00 | 0.50 | 0.15 | 0.05 | 0.004 | |
| 32 | 6.00 | 7.50 | 5.75 | 5.35 | 4.50 | 12.50 | 1.10 | 0.15 | 0.05 | 0.004 | |
| 33 | 5.80 | 8.00 | 5.75 | 5.15 | 4.50 | 10.00 | 0.60 | 0.15 | 0.05 | 0.004 | |
| 34 | 6.00 | 8.50 | 6.00 | 5.15 | 4.50 | 12.50 | 1.00 | 0.15 | 0.05 | 0.004 | |

TABLE II

| Alloy # | Al | Ta | W | Re | Cr | Co | Mo | Hf | C | B | Other |
|---|---|---|---|---|---|---|---|---|---|---|---|
| RAT-0 | 6.24 | 7.02 | 5.75 | 6.32 | 4.50 | 12.50 | 0.00 | 0.15 | 0.05 | 0.004 | |
| RAT-1 | 6.12 | 8.15 | 5.75 | 5.69 | 4.50 | 12.50 | 0.00 | 0.15 | 0.05 | 0.004 | |
| RAT-2 | 6.36 | 7.65 | 5.75 | 5.15 | 4.50 | 12.50 | 0.00 | 0.15 | 0.05 | 0.004 | |
| RAT-3 | 6.48 | 6.50 | 5.75 | 5.78 | 4.50 | 12.50 | 0.00 | 0.15 | 0.05 | 0.004 | |
| RAT-4 | 6.36 | 5.88 | 5.75 | 6.96 | 4.50 | 12.50 | 0.00 | 0.15 | 0.05 | 0.004 | |
| RAT-5 | 6.12 | 6.40 | 5.75 | 7.49 | 4.50 | 12.50 | 0.00 | 0.15 | 0.05 | 0.004 | |
| RAT-6 | 6.00 | 7.53 | 5.75 | 6.86 | 4.50 | 12.50 | 0.00 | 0.15 | 0.05 | 0.004 | |

TABLE II-continued

| Alloy # | Al | Ta | W | Re | Cr | Co | Mo | Hf | C | B | Other |
|---|---|---|---|---|---|---|---|---|---|---|---|
| RAT-7 | 6.01 | 8.11 | 5.75 | 6.26 | 4.50 | 12.50 | 0.00 | 0.15 | 0.05 | 0.004 | |
| RAT-8 | 5.89 | 8.65 | 5.75 | 6.23 | 4.50 | 12.50 | 0.00 | 0.15 | 0.05 | 0.004 | |
| RAT-9 | 6.01 | 8.69 | 5.75 | 5.67 | 4.50 | 12.50 | 0.00 | 0.15 | 0.05 | 0.004 | |
| RAT-10 | 6.12 | 8.74 | 5.75 | 5.10 | 4.50 | 12.50 | 0.00 | 0.15 | 0.05 | 0.004 | |
| RAT-11 | 5.89 | 9.23 | 5.75 | 5.64 | 4.50 | 12.50 | 0.00 | 0.15 | 0.05 | 0.004 | |
| RAT-12 | 6.01 | 9.28 | 5.75 | 5.07 | 4.50 | 12.50 | 0.00 | 0.15 | 0.05 | 0.004 | |
| RAT-13 | 5.78 | 9.76 | 5.75 | 5.61 | 4.50 | 12.50 | 0.00 | 0.15 | 0.05 | 0.004 | |
| RAT-14 | 5.78 | 10.33 | 5.75 | 5.02 | 4.50 | 12.50 | 0.00 | 0.15 | 0.05 | 0.004 | |
| RAT-15 | 5.89 | 10.38 | 5.75 | 4.45 | 4.50 | 12.50 | 0.00 | 0.15 | 0.05 | 0.004 | |
| RAT-16 | 5.66 | 10.85 | 5.75 | 5.00 | 4.50 | 12.50 | 0.00 | 0.15 | 0.05 | 0.004 | |
| Rene 162 | 6.25 | 7.00 | 5.75 | 6.25 | 4.50 | 12.50 | 0.00 | 0.15 | 0.05 | 0.004 | |

Typical of the present invention is alloy 32 in FIG. 4 with 5.35 wt% Re and substantially no SRZ formation under the coating. In contrast, alloy R'162 in FIG. 4 with 6.25 wt% Re exhibited greater than 97 % SRZ under the coating, as shown in FIG. 1.

Testing of alloys identified in Table I resulted in the data summarized in FIG. 4. Data represented by the open circles were compositions within the scope of the present invention except, in some examples, for Re content as shown. The black diamonds, squares, circles and triangles represent the identified compositional variations which resulted in excessive SRZ formation. From these data, it can be seen that 4.25 wt% Cr is insufficient, and Co without Mo Provides unacceptable SRZ, as does 6.25 wt% or more Al and 9.25 wt% or more Ta. Therefore, with Re in the range of about 5.1-5.6 wt%, and preferably 5.1-5.4 wt%, the present invention, in one form, includes the combination of about 5 to less than 6.25 wt% Al, and preferably about 5.5-6 wt% Al, greater than 4.25 to about 6 wt% Cr, and preferably about 4.5-5 wt% Cr, about 7 to less than 9.25 wt% Ta, and about 0.5-2 wt% Mo, along with about 10-15 wt% Co, and preferably about 10-13 wt% Co, about 5-6.5 wt% W, and preferably about 5.5-6 wt% W, about 0.003-0.01 wt% B about 0.02-0.07 wt% C, about 0.1-0.5 wt% Hf, and the balance Ni and incidental impurities.

The following Table III compares Re content with the formation of SRZ. In Table III, alloy R'162 is within the scope of the cross-referenced application. Alloys 32 and 34 are specifically preferred forms of the Present invention. Alloy 33, within the present invention, and including nominally 1 wt% Mo, is useful under slightly lower stress rupture requirements. Alloys 32, 33 and 34 include Re in the range of 5.1-5.6 wt%, according to the present invention.

mechanism which drives the formation of such undesirable constituents.

Figure 6:
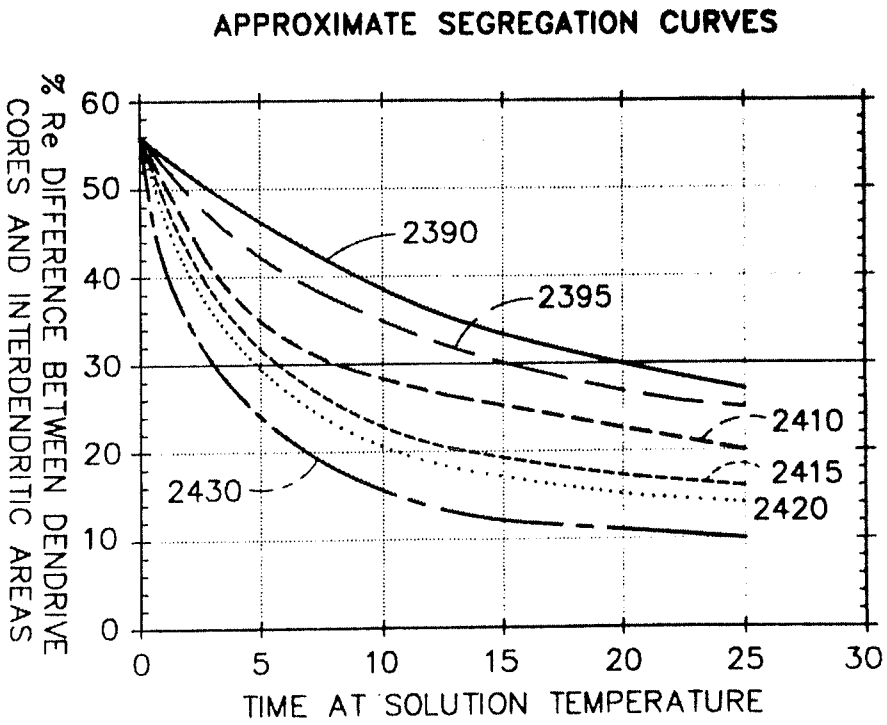
FIG. 6 is a graphical summary of the diffusion profile of Re at different solution temperatures.

In respect to such segregation, it was recognized that Re is the slowest diffusing element in the type of alloys represented by the present invention and by the invention of the cross-referenced application. Accordingly, it is important to minimize the compositional gradient of Re between dendritic and interdendritic areas because it contributes largely to detrimental Phases, such as internal SRZ. Testing of alloy R'162 and alloys within the scope of the present invention confirmed the segregation rates of Re in these types of alloys. The data of the graphical Presentation of FIG. 6 summarizes the diffusion profile of Re at different solution temperatures for alloys within the scope of the present invention. The as cast single crystal material as shown in FIG. 6, starts with about a 55% difference in Re between dendritic cores and interdendritic areas. However by appropriate solution heat treatment, Particularly in the range of at least about 2400° F. to below incipient melting, a difference of about 30% or less can be maintained according to the present invention. As will be discussed in detail later, one form of the present invention utilizes a solution heat treatment in such a range which selects time at temperature to minimize SRZ formation by minimizing chances for Re to cause such deleterious constituents to precipitate.

During evaluation of the present invention, a parameter was developed to quantify the segregation of important elements included in the present alloy. This parameter, herein called the segregation parameter (S.P.) accounts for the diffusion profiles not only of Re but also of W, Ta and Al. The S.P. is defined as follows:

$$S.P. = \frac{\text{wt \% difference of (Re + W + Ta + Al)}}{4}$$

TABLE III

SRZ Propensity for Rene N6 Candidates vs. R162 and N5

| Alloy | Al | Ta | W | Re | Cr | Mo | Co | Hf | C | B | % SRZ at 2000° F. |
|---|---|---|---|---|---|---|---|---|---|---|---|
| 32 | 6.00 | 7.50 | 5.75 | 5.35 | 4.50 | 1.10 | 12.50 | 0.15 | 0.05 | 0.004 | 0.10 |
| 33 | 5.80 | 8.00 | 5.75 | 5.15 | 4.50 | 0.60 | 10.00 | 0.15 | 0.05 | 0.004 | 0.50 |
| 34 | 6.00 | 8.50 | 6.00 | 5.15 | 4.50 | 1.10 | 12.50 | 0.15 | 0.05 | 0.004 | 1.10 |
| R162 | 6.25 | 7.00 | 5.75 | 6.25 | 4.50 | 0.00 | 12.50 | 0.15 | 0.05 | 0.004 | 97.40 |
| N5 | 6.20 | 6.50 | 5.00 | 3.00 | 7.00 | 1.50 | 7.50 | 0.15 | 0.05 | 0.004 | — |

Figure 5:
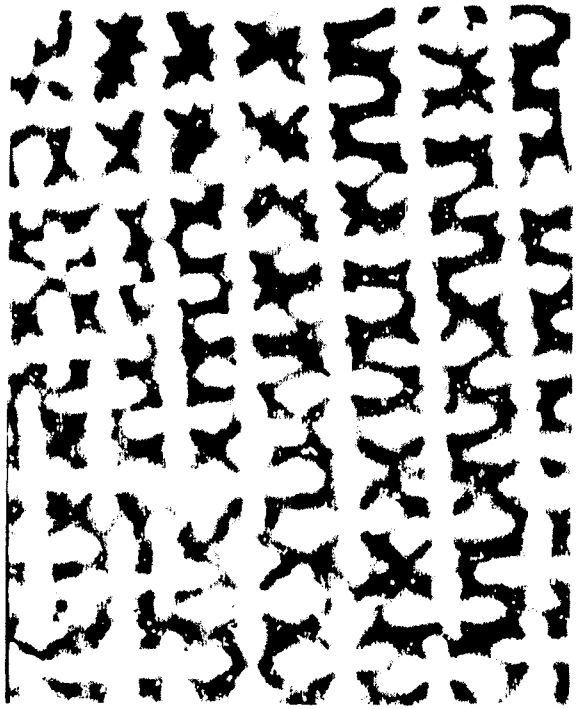
FIG. 5 is a photomicrograph at 50× showing the dendritic microstructure of Alloy R'162.
Figure 7:
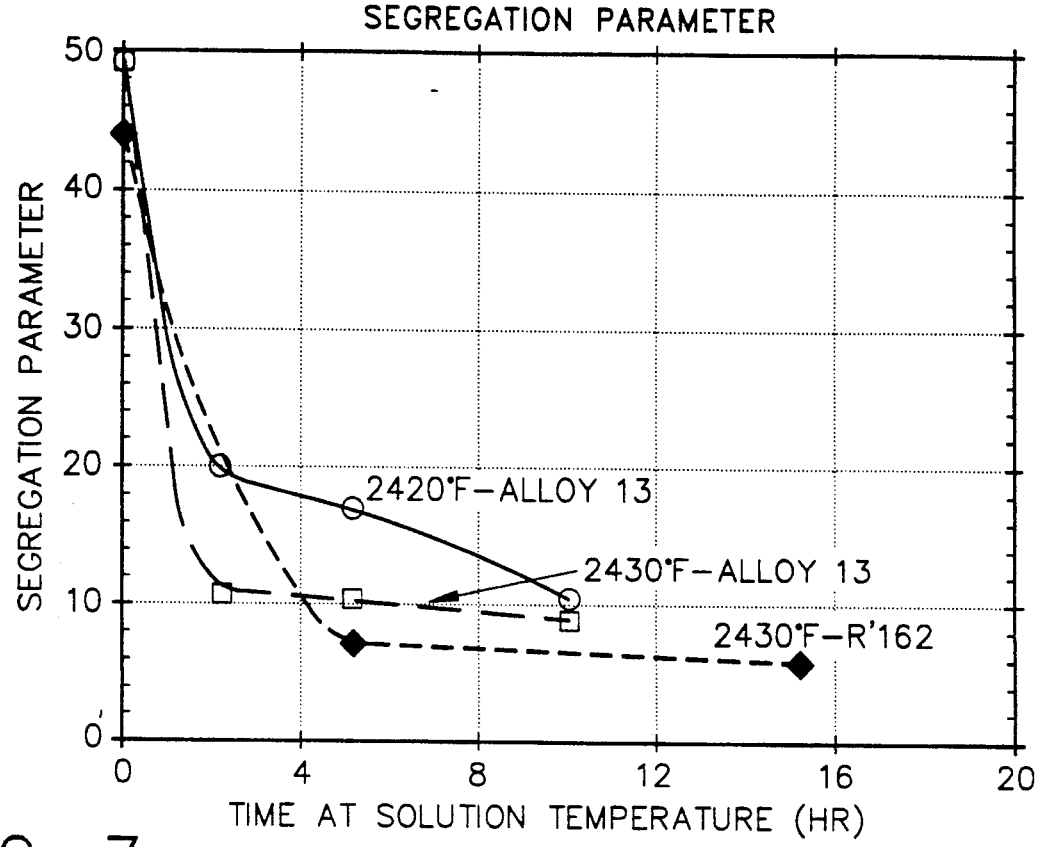
FIG. 7 is a graphical Presentation of Segregation Parameter (S.P.) as a function of time at solution temperature.

FIG. 5 is a photomicrograph at 100× showing the dendritic microstructure of alloy R'162. Analysis determined that the dendrites, shown as white crosses, were rich in Re and W, and the interdendritic areas were rich in Ta and Al. As a result of the solidification Process, segregation occurs and the difference between the cores and the interdentritic areas promotes formation of a detrimental SRZ-type constituent. Reduction in Re content, according to the present invention, reduced the In the above formula, the difference refers to the compositional difference of each element between the dendritic cores and the interdendritic areas. Comparison of alloy 13, having a nominal composition, by wt%, of 6.0% Al, 7.5% Ta, 5.8% W, 5.5% Re, 4.5% Cr, 12 5% Co, 1.0% Mo, 0.05% C, 0.15% Hf, 0.004% B, with the balance Ni and incidental impurities, with alloy R'162 in connection with time at solution temperatures to generate a S.P. is shown in the graphical presentation of FIG. 7. According to the present invention, in one form, a S.P. of no more than about 15 is preferred to inhibit the formation of undesirable SRZ. This value of about 15 is selected because it is believed that S.P. of at or less than this value will be effective in inhibiting SRZ formation based on diffusion Profiles observed in alloy R'162. For example, a time at solution temperature of at least about 4 hours at about 2430° F. will result in a satisfactory segregation condition to avoid SRZ formation. It has been recognized that such desirable condition can be developed, according to a form of the present invention, with a solution heat treatment of the alloy of this invention in the range of about 2400° F. to about 2440° F. for at least 4 hours, with the combination of time and temperature to give a S.F. of 15 or below. Solution temperatures at about 2390° F. will require much longer times, for example 24–48 hours, than will solution temperatures at about 2430° F., for example about 4 hours. A temperature of 2415° F. for 2 hours was not adequate to reduce the segregation level sufficiently. A preferred heat treatment for the present invention includes a solution temperature of about 2430° F. for about 4 hours to inhibit formation of internal SRZ.

Figure 8:
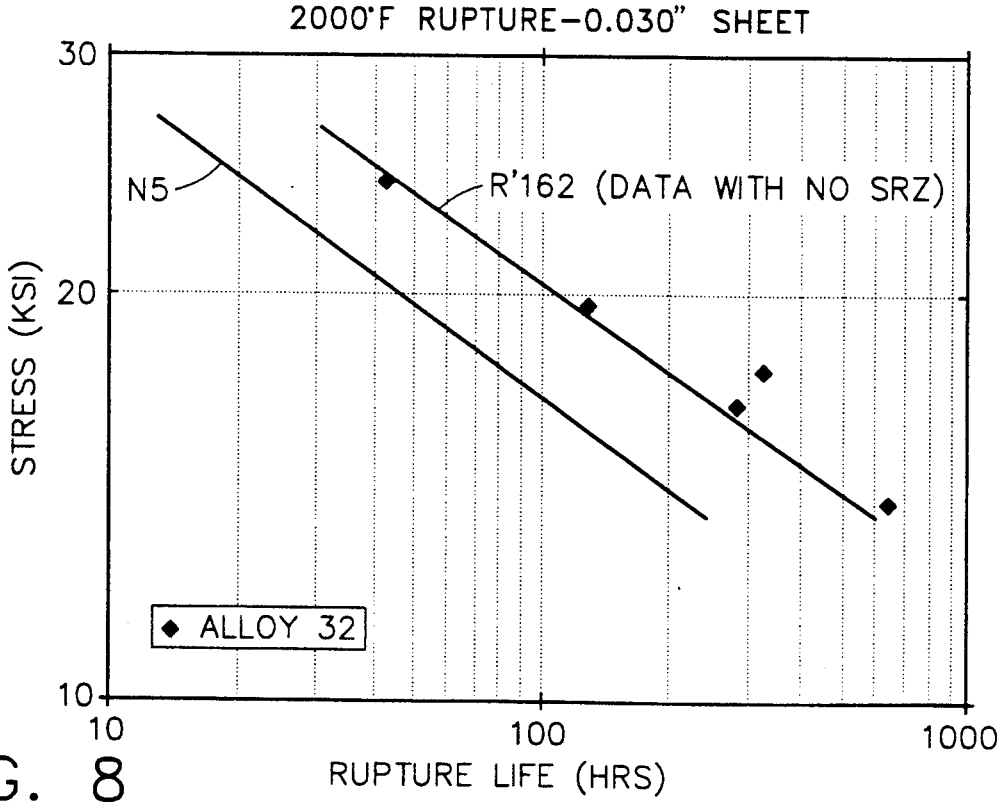
FIG. 8 is a graphical comparison of stress rupture Properties at 2000° F. compared to R'162.

Reduction of Re in the alloy of the present invention, in comparison with alloy R'162 can result in loss of stress rupture strength. Therefore Mo was a definite alloying addition in the present invention along with Ta. Mo is included in the alloy of the present invention in the range of about 0.5–2 wt%, and preferably in the range of about 0.6–1.5 wt%, with Ta in the range of about 7–9 wt%, and preferably in the range of about 7.5–8.5 wt%, to enhance stress rupture strength and to make it comparable to that of alloy R'162. The graphical presentation of FIG. 8 compares stress rupture Properties of alloy 32 of the Present invention, shown as solid triangles, with alloy R'162 and alloy N5 at 2000° F.

Figure 9:
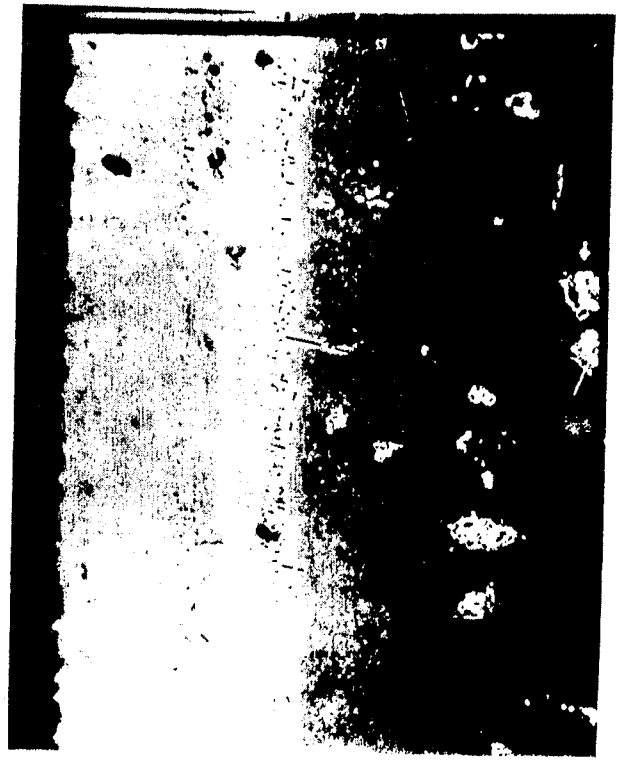
FIG. 9 is a photomicrograph at 200× of the alloy of the present invention coated with PtA1 and exhibiting only a narrow region of sigma-type TCP under the coating.

In addition, it was recognized that the addition of Mo in the range of about 0.5–2 wt% promotes the formation of the less undesirable sigma TCP phase beneath a coating, such as PtA1 as shown in FIG. 9, rather than the above mentioned "P" phase as shown in FIG. 1. Even though sigma phase is not a desirable one to occur within the body of a Ni-base superalloy, it was recognized that the formation of a small layer of sigma needles beneath the PtA1 coating tended to stabilize the structure and occurred in an area of less significance from loss of stress rupture viewpoint.

The alloy of the present invention also includes intentional additions of small, but measurable amounts of C, B and Hf. These elements are not present as incidental impurities, but rather are included to develop specific properties. C is added to allow for a cleaner melting alloy and to aid in promoting corrosion resistance. Hf is added to improve the oxidation resistance of the alloy and to improve its coating compatibility and life. C and B are added as low angle grain boundary strengtheners, low angle grain boundaries typically being present in single crystal alloys.

During evaluation of the present invention, a large number of comparisons were made between alloy composition and SRZ formation. Such comparisons were made after stress rupture tests at 2000° F. as well as alloy specimens coated with PtA1 and with an aluminide coating, widely known in the art as CODEP coating, and exposed at 2000° F. for 400 hours without load. The above described detrimental effects of excessive SRZ, both within the body of certain specimens and under the coatings, were observed. For example, secondary cracking is nucleated at the SRZ interface under tension. Also coated specimens suffered life loss by base material consumption during test and the easy nucleation of cracks. Structures as are shown in FIGS. 1 and 2 initiated such detrimental effects.

A variety of alloy compositions were machined as rectangular specimens and Pt-Al coated by CVD process. They were then exposed at 2000° F. for 400 hours and the SRZ measured beneath the coating. The total linear percent of SRZ formed beneath the coating was taken as the alloys susceptibility for SRZ formation. Statistical analysis of the results of these evaluations produced the following relationship for use in a method for predicting the amount of SRZ which will form in an alloy. This relationship, in which the listed elements are in atomic percent, was Produced by multiple regression techniques:

$$[SRZ(\%)]^{\frac{1}{2}} = 13.88(\%\ Re) + 4.10(\%\ W) - 7.07(\%\ Cr) - 2.94(\%\ Mo) - 0.33(\%\ Co) + 12.13$$

Figure 10:
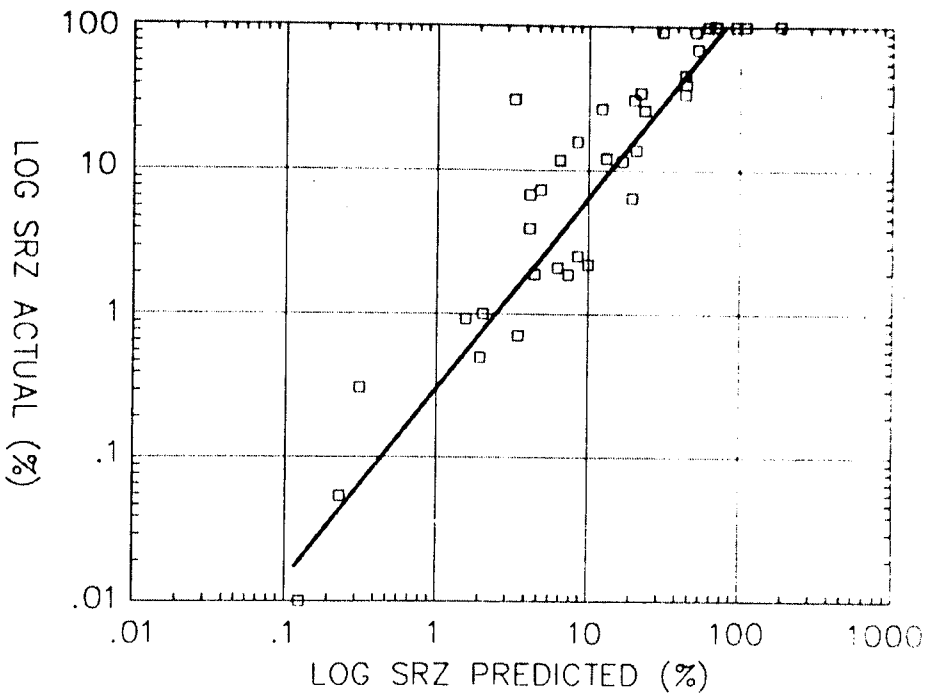
FIG. 10 is a graphical comparison of actual percentage SRZ with predicted Percentage SRZ.

The graphical presentation of FIG. 10 is a comparison summary of a large number of data points. The accuracy of the above relationship is shown clearly.

The present invention has been described in connection with various examples, forms and embodiments. However, those skilled in the art to which this subject matter relates will recognize the scope and variations of which this invention is capable without departing from the scope of the appended claims. The presented examples, forms and embodiments are representative of the invention and are not intended to be limitations.

We claim:

1. A nickel base superalloy of improved high temperature stability, characterized by a unique combination of Re content in the presence of Al, Cr, Ta and Mo in defined ranges to provide desired mechanical properties for high temperature use while avoiding the detrimental formation of a Secondary Reaction Zone (SRZ) in the microstructure of the alloy after exposure to the combination of temperatures of at least about 2000° F. and operational load, consisting essentially of, in weight percent, the combination of about 5.1–5.6% Re, about 5 to less than 6.25% Al, greater than 4.25 to about 6% Cr, about 7 to less than 9.25% Ta, and about 0.5–2% Mo, along with about 10–15% Co, about 5–6.5% W, about 0.1–0.5% Hf, about 0.02–0.07% C, about 0.003–0.01% B, about 0–0.03% Y, about 0–6% Ru, about 0–1% Cb, balance Ni and incidental impurities.

2. The superalloy of claim 1 in which:
Re is 5.1–5.4%,
Al is 5.5–6%,
Cr is 4.5–5%,
Ta is 7.5–8.5%,
Mo is 0.6–1.5%,
Co is 10–13%, and
W is 5.5–6%..

3. The superalloy of claim 1 in which the Re is 5.35%, the Al is about 6.0%, the Cr is about 4.5%, the Ta is about 7.5%, the Mo is about 1.1%, the Co is about 12.5%, the W is about 5.75%, the C is about 0.05%, the Hf is about 0.15%, and the B is about 0.004%.

4. The superalloy of claim 1 further characterized by the substantial absence, in its internal microstructure, of SRZ after exposure at 2000° F. for 1000 hours under a 15 ksi load.

5. The superalloy of claim 1 having a surface coated with a metal selected from the group consisting of Al, Pt and their mixtures and alloys, and further characterized by no more than about 2 percent SRZ linearly beneath and adjacent the coating after exposure to at least 1800° F. for about 400 hours.

6. A single crystal article having improved high temperature strength and stability as a result of being made from the superalloy of claim 1 and characterized by the substantial absence of SRZ internally of the article after exposure at about 2000° F. for about 1000 hours under a stress of about 15 ksi.

7. A single crystal article having improved high temperature strength and stability and including a surface coated with a metal selected from the group consisting of Al, Pt and their mixtures and alloys, and characterized further by no more than about 2 Percent SRZ Phase linearly beneath and adjacent the coating after exposure to at least about 1800° F. for about 400 hours.

8. A single crystal article made from the alloy of claim 1 and including in its microstructure dendritic cores separated by interdendritic areas, the article characterized by having a compositional difference in segregation distribution of the elements Re, W, Ta and Al between the cores and interdendritic areas of no more than a Segregation Parameter (S.P.) of about 15 wherein:

$$S.P. = \frac{\text{wt \% difference of (Re + W + Ta + Al)}}{4}$$

9. A method for heat treating a nickel base superalloy of improved high temperature stability, characterized by a unique combination of Re content in the presence of Al, Cr. Ta and Mo in the defined ranges to provide desired mechanical properties for high temperature use while avoiding the detrimental formation of a Secondary Reaction Zone (SRZ) in the microstructure of the alloy after exposure to the combination of temperatures of at least about 2000° F. and operational load, the alloy consisting essentially of in weight percent, the combination of about 5.1-5.6% Re, about 5 to less than 6.25% Al, greater than 4.25 to about 6% Cr, about 7 to less than 9.25% Ta, and about 0.5-2% Mo, along with about 10-15% Co, about 5-6.5% W, about 0.1-0.5% Hf about 0.02-0.07% C, about 0.003-0.01% B, about 0-0.03% Y, about 0-6% Ru, about 0-1% Cb, balance Ni and incidental impurities, comprising the step of solution treating the alloy by heating in the range of about 2390° F. to below incipient melting of the alloy and holding at the temperature for a time sufficient to result in a Segregation Parameter (S.P.) of no more than about 15 by minimizing the compositional gradient of Re between dendritic and interdendritic areas.

10. The method of claim 9 wherein heating is conducted in the range of about 2390°-2440° F. for at least 4 hours.

11. The method of claim 10 wherein heating is conducted in the range of about 2410°-2430° F. for from 4 to 12 hours.

* * * * *